United States Patent [19]

Nakamura et al.

[11] 4,385,111

[45] May 24, 1983

[54] COLOR PHOTOGRAPHIC SENSITIVE MATERIALS

[75] Inventors: Kotaro Nakamura; Takayoshi Kamio; Nobuo Furutachi, all of Minami-ashigara, Japan

[73] Assignee: Fuji Photo Film Co., Ltd., Kanagawa, Japan

[21] Appl. No.: 387,127

[22] Filed: Jun. 10, 1982

[30] Foreign Application Priority Data

Jun. 10, 1981 [JP] Japan ..... 56-89113

[51] Int. Cl.[3] ..... G03C 1/40

[52] U.S. Cl. ..... 430/551; 430/555; 430/558

[58] Field of Search ..... 430/372, 381, 548, 551, 430/555, 558

[56] References Cited

U.S. PATENT DOCUMENTS

| | | | |
|---|---|---|---|
| 4,268,621 | 5/1981 | Ogi et al. | 430/551 |
| 4,310,623 | 1/1982 | Watanabe et al. | 430/551 |
| 4,351,897 | 9/1982 | Aoki et al. | 430/555 |

FOREIGN PATENT DOCUMENTS 2077455 12/1981 United Kingdom .

*Primary Examiner*—J. Travis Brown

*Attorney, Agent, or Firm*—Sughrue, Mion, Zinn, Macpeak and Seas

[57] ABSTRACT

A silver halide color photographic sensitive material is disclosed. The material is comprised of at least one 4-(2-alkoxyarylthio)-5-pyrazolone magenta dye forming coupler and at least one compound represented by general formula (I):

(I)

wherein each R represents an alkyl group, an alkenyl group, an aryl group, a 5- or 6-membered heterocyclic group having an oxygen atom or a nitrogen atom as a hetero atom, $R_4CO$—, $R_4SO_2$— or $R_4NHCO$—, $R_1$ and $R_2$ each represents a hydrogen atom, a halogen atom, an alkyl group, an alkenyl group, an alkoxy group or an alkenoxy group and $R_3$ represents a hydrogen atom, an alkyl group, an alkenyl group or an aryl group, wherein $R_4$ represents an alkyl group, an alkenyl group, an aryl group or a heterocyclic group.

The material can be used to form a color image with improved light and heat fastness.

5 Claims, No Drawings

COLOR PHOTOGRAPHIC SENSITIVE MATERIALS

FIELD OF THE INVENTION

The present invention relates to color photographic sensitive materials and, particularly, to color photographic sensitive materials which have a high dye forming efficiency and which do not negatively influence photographic properties by changing the pH of the color developing bath (more specifically, they have an improved processing stability), by which the effects of fading of dye images finally obtained by development and discoloration of undeveloped portions (hereinafter, referred to as background) are reduced.

BACKGROUND OF THE INVENTION

Various pyrazolone derivatives are known as magenta dye forming couplers (hereinafter, referred to as a magenta coupler). However, pyrazolone derivatives generally used for photographic sensitive materials are 4-equivalent couplers. Such compounds theoretically require the development of 4 moles of silver halide as an oxidizing agent for forming 1 mole of a dye by reacting with an aromatic primary amine developing agent. On the contrary, pyrazolones having an active methylene group substituted by a group which can be released by oxidative coupling with an oxidation product of the primary amine developing agent require development of only two moles of silver halide. In addition, the 4-equivalent pyrazolone derivatives have a low color forming efficiency (conversion of the coupler into the dye) and form generally only a ½ mole or so of the dye per mole of the coupler.

As a means for improving the color forming efficiency by decreasing the amount of silver halide required for development, utilization of 2-equivalent pyrazolone magenta couplers has been proposed. Examples of pyrazolone derivatives which release an oxygen atom include compounds having an aryloxy group in the 4-position of 5-pyrazolone as described in U.S. Pat. No. 3,419,391 and compounds having an acyloxy group as described in U.S. Pat. Nos. 3,311,476 and 3,926,631. In these cases, the finally resulting 2-equivalent magenta couplers become remarkably expensive because they are synthesized by complicated steps. The use of such couplers is not desirable because the cost of producing sensitive materials with them does not decrease much even if the amount of silver halide or the amount of couplers is reduced by half.

Examples of pyrazolone derivatives which release a nitrogen atom include compounds having an imidazolyl group, a pyrazolyl group or a triazolyl group in the 4-position of 5-pyrazolone as described in U.S. Pat. Nos. 4,076,533 and 4,241,168. Synthesis of these couplers from 4-equivalent couplers which have no substituent on the coupling position requires 2 to 4 steps. Consequently, such couplers are expensive. In addition, photographic properties are sometimes damaged, because some of these couplers are unstable or have a low reaction rate for coupling with the oxidation product of aromatic primary amine.

Examples of pyrazolone derivatives which release a sulfur atom include compounds having a heterocyclic thio group or an arylthio group in the 4-position of 5-pyrazolone as described in U.S. Pat. No. 3,227,554, compounds having a thiocyano group as described in U.S. Pat. No. 3,214,437 and compounds having a dithiocarbamate group as described in U.S. Pat. No. 4,032,346. These compounds are advantageous in that most of them can be synthesized from 4-equivalent pyrazolones by one step. However, when they are incorporated in the silver halide sensitive materials, the mercapto compound released during the development reacts with the silver halide and resulted in inhibition of development. Furthermore, such a compound is generally very unstable. Consequently, it is difficult to use them for common uses and they are used only in special cases.

SUMMARY OF THE INVENTION

The present inventors have carried out various studies relating to couplers having excellent photographic properties and an improved color forming efficiency which can be produced at a moderate price. Specific attention was given to couplers which require half the amount of silver halide which is an essential advantage of the 2-equivalent magenta couplers. As a result of these studies, the present inventors have found that compounds having a 2-alkoxyarylthio group in the 4-position of 5-pyrazolone have particularly excellent properties among couplers of the type which release an arylthio group. Furthermore, the present inventors unexpectedly discovered that magenta images formed from conventional couplers having an arylthio group have remarkably inferior fastness to light, while magenta images formed from pyrazolone couplers used in the present invention have good fastness to light.

When making color photographic sensitive materials, the influence upon photographic properties caused by variation of pH of the color developing solution must be eliminated and the antifading must be excellent. It is particularly important to eliminate fading of dye images and discoloration of the background.

Although 4-(2-alkoxyarylthio)-5-pyrazolone couplers have particularly excellent properties as described above, it is very important to further eliminate the fading of images and the discoloration of background. As a result of using various antifading agents and antistain agents together with the couplers, the present inventors have found tetraalkoxybiindane derivatives which are singularly effective for preventing fading of the images and preventing discoloration of the background.

An object of the present invention is to provide a process for improving a color forming efficiency of couplers, decreasing an amount of silver halide and reducing an influence upon photographic properties caused by variation of pH of the color developing solution. Another object of the present invention is to provide a process for reducing fading and discoloration of dye images after the development processing and reducing discoloration of the background.

The above described objects of the present invention can be effectively attained by incorporating at least one kind of 4-(2-alkoxyarylthio)-5-pyrazolone couplers and at least one kind of tetraalkoxybiindane derivative represented by the following formula (I) in a photosensitive silver halide emulsion for silver halide color photographic sensitive materials:

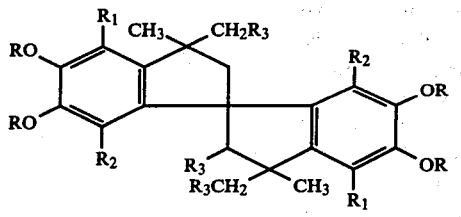

(I)

wherein R represents an alkyl group, an alkenyl group, an aryl group, a 5- or 6-membered heterocyclic group having an oxygen atom or a nitrogen atom as a hetero atom, $R_4CO$—, $R_4SO_2$— or $R_4NHCO$—, $R_1$ and $R_2$ each represents a hydrogen atom, a halogen atom, an alkyl group, an alkenyl group, an alkoxy group or an alkenoxy group, and $R_3$ represents a hydrogen atom, an alkyl group, an alkenyl group or an aryl group, wherein $R_4$ represents an alkyl group, an alkenyl group, an aryl group or a heterocyclic group.

The following improved, unexpected results can be obtained by using the above described couplers together with tetraalkoxybiindane derivatives.

(1) Color images obtained by coupling with the oxidation product of a color developing agent (for example, a p-phenylenediamine developing agent) becomes remarkably fast to light and heat.

(2) The background after color development processing undergoes a remarkably reduced degree of discoloration by light and heat.

(3) The color forming efficiency of magenta couplers is remarkably improved. Accordingly, the amount of magenta couplers used can be reduced as compared with prior cases. Further, since the amount of silver halide used can be remarkably reduced, the thickness of the magenta image forming emulsion layer is reduced. As the result, sharpness of the images can be remarkably improved.

(4) The color photographic sensitive materials can be produced at a low cost, because smaller amounts of couplers and silver halides are needed.

(5) The color development step is stabilized. (Sensitive materials which are hardly influenced by variation of pH of the photographic processing solutions are obtained.)

(6) Color photographic sensitive materials having stabilized quality can be obtained. Such materials do not create abnormal coloration by development even if allowed to stand in the presence of formalin before development.

(7) It is possible to obtain color photographic sensitive materials which form dye images having excellent granularity by development processing.

(8) It is possible to obtain color photographic sensitive materials which are stable even if preserved for a long period of time prior to development.

DETAILED DESCRIPTION OF THE INVENTION

Magenta couplers which release an arylthio group used in the present invention can be represented by the following formula (II).

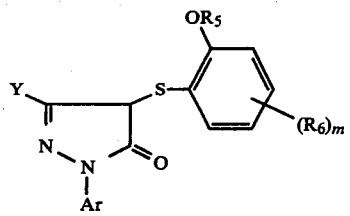

(II)

wherein Ar represents a phenyl group substituted with at least one halogen atom, an alkyl group, an alkoxy group, an alkoxycarbonyl group or a cyano group, $R_5$ represents an alkyl group or an aryl group, $R_6$ represents a hydrogen atom, a halogen atom, an acylamino group, a sulfonamide group, a carbamoyl group, a sulfamoyl group, an alkylthio group, an alkoxycarbonyl group, a hydroxy group, an alkyl group, an alkoxy group or an aryl group, m represents an integer of 1 to 4, and Y represents an acylamino group or an anilino group.

Particularly preferred compounds in the compounds represented by the formula (II) can be represented by the formula (III).

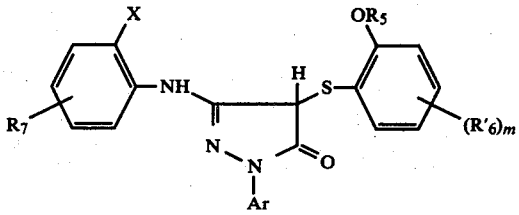

(III)

wherein $R_5$, m and Ar each represents the same meaning as in the formula (II), X represents a halogen atom or an alkoxy group, $R'_6$ represents a hydrogen atom, a hydroxy group, a halogen atom, an alkyl group, an alkoxy group or an aryl group, and $R_7$ represents a hydrogen atom, a halogen atom, an alkyl group, an alkoxy group, an acylamino group, a sulfonamide group, a sulfamoyl group, a carbamoyl group, a diacylamino group, an alkoxycarbonyl group, an alkoxysulfonyl group, an aryloxysulfonyl group, an alkanesulfonyl group, an arylsulfonyl group, an alkylthio group, an arylthio group, an alkyloxycarbonylamino group, an alkylureido group, an acyl group, a nitro group, a carboxyl group or a trichloromethyl group.

More particularly, Ar represents a substituted phenyl group, wherein examples of substituents include halogen atoms (for example, a chlorine atom, a bromine atom or a fluorine atom, etc.), alkyl groups having 1 to 22 carbon atoms (for example, a methyl group, an ethyl group, a tetradecyl group or a t-butyl group, etc.), alkoxy groups having 1 to 22 carbon atoms (for example, a methoxy group, an ethoxy group, an octyloxy group or a dodecyloxy group, etc.), alkoxycarbonyl groups having 2 to 23 carbon atoms (for example, a methoxycarbonyl group, an ethoxycarbonyl group or a tetradecyloxycarbonyl group, etc.) and a cyano group, etc.

More particularly, X represents a halogen atom (for example, a chlorine atom, a bromine atom or a fluorine atom, etc.) or an alkoxy group having 1 to 22 carbon atoms (for example, a methoxy group, an octyloxy group or a dodecyloxy group, etc.).

More particularly, $R_7$ represents a hydrogen atom, a halogen atom (for example, a chlorine atom, a bromine atom or a fluorine atom, etc.), a straight or branched chain alkyl group (for example, a methyl group, a t-butyl group or a tetradecyl group, etc.), an alkoxy group (for example, a methoxy group, an ethoxy group, a 2-ethylhexyloxy group or a tetradecyloxy group, etc.), an acylamino group (for example, an acetamide group, a benzamide group, a butanamide group, a tetradecanamide group, an α-(2,4-di-tert-amylphenoxy)acetamide group, an α-(2,4-di-tert-amylphenoxy)-butylamide group, an α-(3-pentadecylphenoxy)hexaneamide group, an α-(4-hydroxy-3-tert-butylphenoxy)tetradecanamide group, a 2-oxo-pyrrolidin-1-yl group, a 2-oxo-5-tetradecylpyrrolidin-1-yl group or an N-methyl-tetradecanamide group, etc.), a sulfonamide group (for example, a methanesulfonamide group, a benzenesulfonamide group, a p-toluenesulfonamide group, an octanesulfonamide group, a p-dodecylbenzenesulfonamide group or an N-methyl-tetradecanesulfonamide group, etc.), a sulfamoyl group (for example, an N-methylsulfamoyl group, an N-hexadecylsulfamoyl group, an N-[3-(dodecyloxy)propyl]sulfamoyl group, an N-[4-(2,4-di-tert-amylphenoxy)butyl]sulfamoyl group or an N-methyl-N-tetradecylsulfamoyl group, etc.), a carbamoyl group (for example, an N-methylcarbamoyl group, an N-octadecylcarbamoyl group, an N-[4-(2,4-di-tert-amylphenoxy)butyl]carbamoyl group or an N-methyl-N-tetradecylcarbamoyl group, etc.), a diacylamino group (for example, an N-succinimide group, an N-phthalimide group, a 2,5-dioxo-1-oxazolidinyl group, a 3-dodecyl-2,5-dioxo-1-hydantoinyl group or a 3-(N-acetyl-N-dodecylamino)succinimide group, etc.), an alkoxycarbonyl group (for example, a methoxycarbonyl group, a tetradecyloxycarbonyl group or a benzyloxycarbonyl group, etc.), an alkoxysulfonyl group (for example, a methoxysulfonyl group, an octyloxysulfonyl group or a tetradecyloxysulfonyl group, etc.), an aryloxysulfonyl group (for example, a phenoxysulfonyl group or a 2,4-di-tert-amylphenoxysulfonyl group, etc.), an alkanesulfonyl group (for example, a methanesulfonyl group, an octanesulfonyl group, a 2-ethylhexanesulfonyl group or a hexandecanesulfonyl group, etc.), an arylsulfonyl group (for example, a benzenesulfonyl group or a 4-nonylbenzenesulfonyl group, etc.), an alkylthio group (for example, an ethylthio group, a hexylthio group, a benzylthio group, a tetradecylthio group or a 2-(2,4-di-tert-amylphenoxy)ethylthio group, etc.), an arylthio group (for example, a phenylthio group or a p-tolylthio group, etc.), an alkyloxycarbonylamino group (for example, an ethyloxycarbonylamino group, a benzyloxycarbonylamino group or a hexadecyloxycarbonylamino group, etc.), an alkylureido group (for example, an N-methylureido group, an N,N-dimethylureido group, an N-methyl-N-dodecylureido group, an N-hexadecylureido group or an N,N-dioctadecylureido group, etc.), an acyl group (for example, an acetyl group, a benzoyl group, an octadecanoyl group or a p-dodecanamidobenzoyl group, etc.), a nitro group, a carboxyl group or a trichloromethyl group. However, in the above described substituents, alkyl groups are those having 1 to 36 carbon atoms, preferably 1 to 22 carbon atoms, and aryl groups are those having 6 to 38 carbon atoms, preferably 6 to 22 carbon atoms.

More particularly, $R_5$ represents an alkyl group having 1 to 22 carbon atoms (for example, a methyl group, a propyl group, a butyl group, a 2-methoxyethyl group, a methoxymethyl group, a hexyl group, a 2-ethylhexyl group, a dodecyl group, a hexadecyl group, a 2-(2,4-di-tert-amylphenoxy)ethyl group, or a 2-dodecyloxyethyl group, etc.) or an aryl group (for example, a phenyl group, an α-naphthyl group, a β-naphthyl group or a 4-tolyl group, etc.).

$R'_6$ represents a hydrogen atom, a hydroxyl group or the same halogen atom, alkyl group, alkoxy group or aryl group as that in $R_7$.

Couplers represented by the formula (III) having a total of carbon atoms in $R_5$ and $R_6'$ of from 6 to 22 are particularly preferred for attaining the objects of the present invention.

In the following, examples of typical couplers used in the present invention are described. However, the present invention is not limited to them.

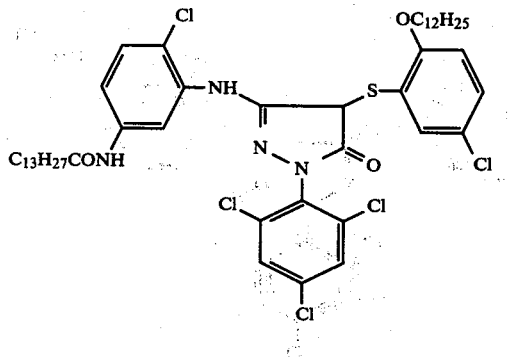

(1)

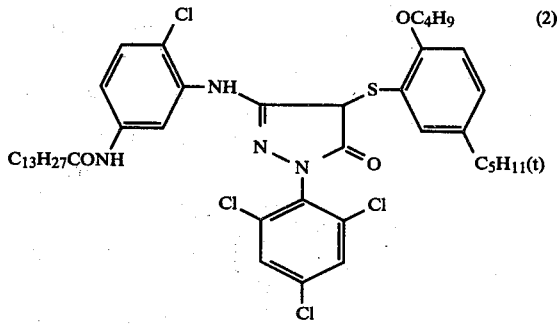

(2)

-continued
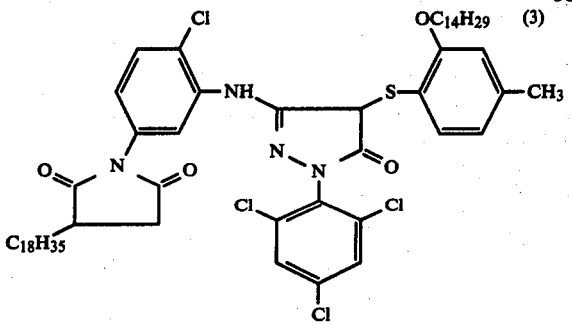
(3)
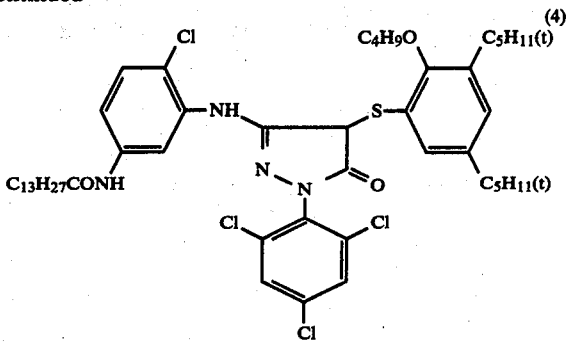
(4)
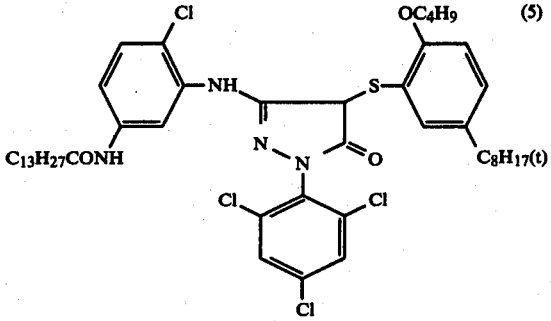
(5)
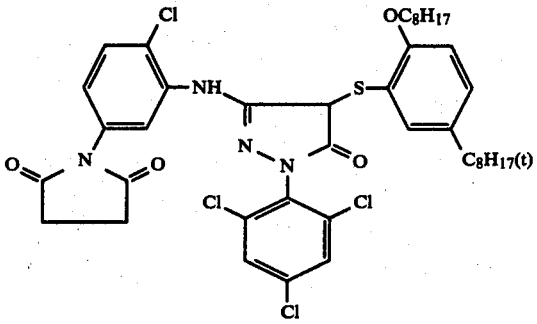
(6)
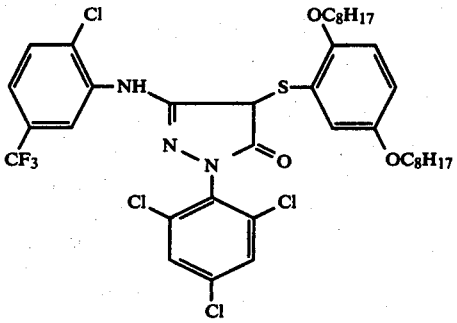
(7)
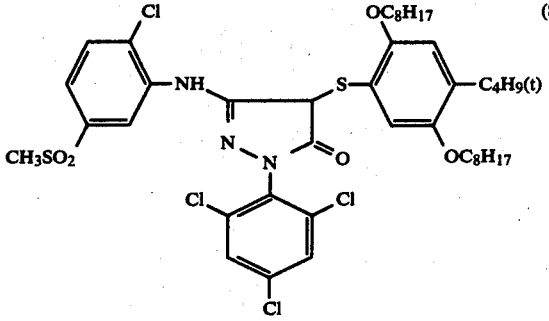
(8)
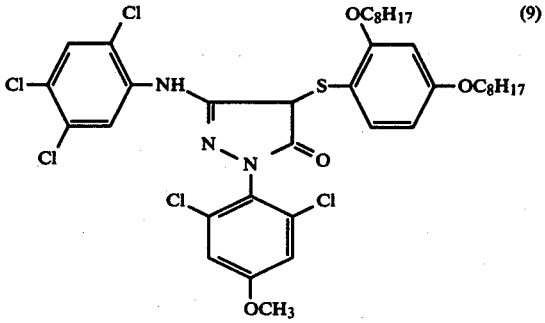
(9)
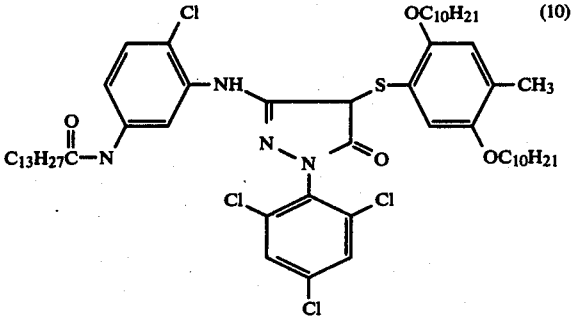
(10)
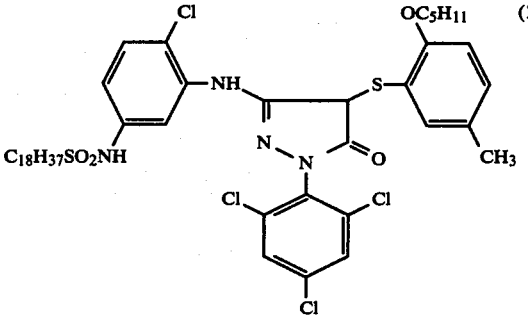
(11)
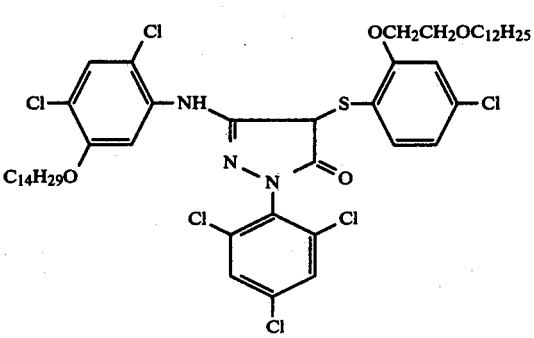
(12)

-continued
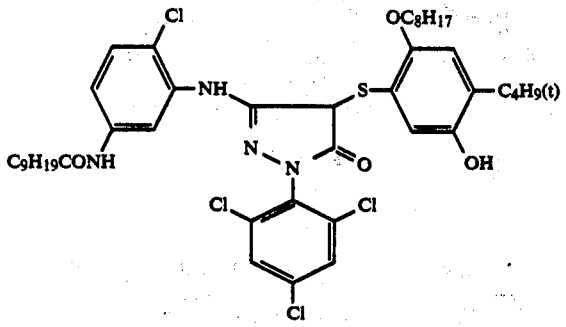
(13)
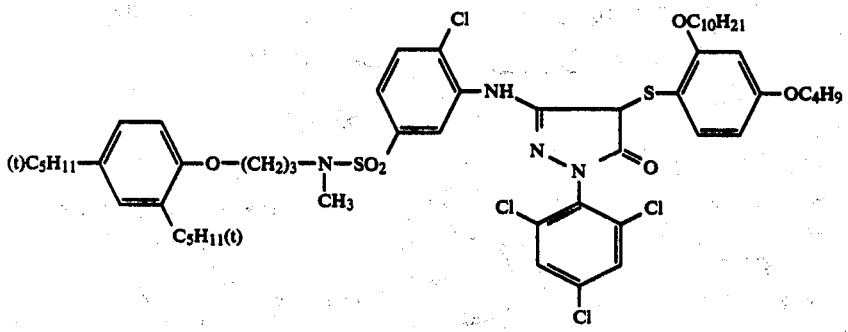
(14)
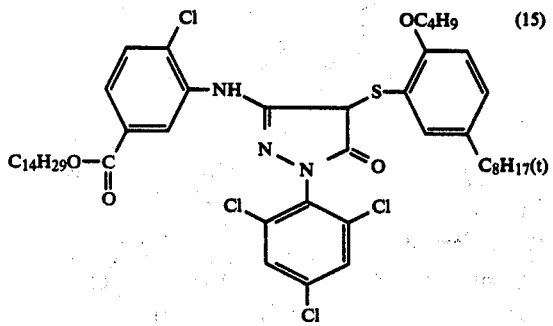
(15)
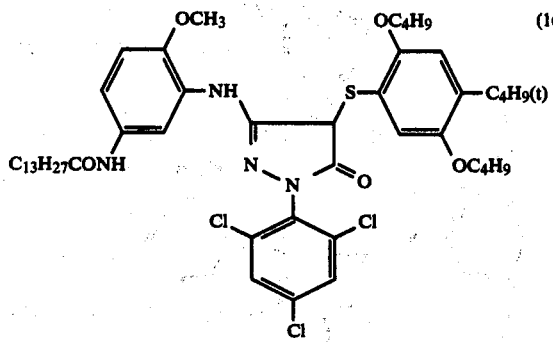
(16)
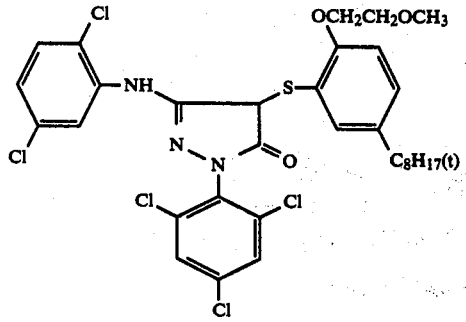
(17)
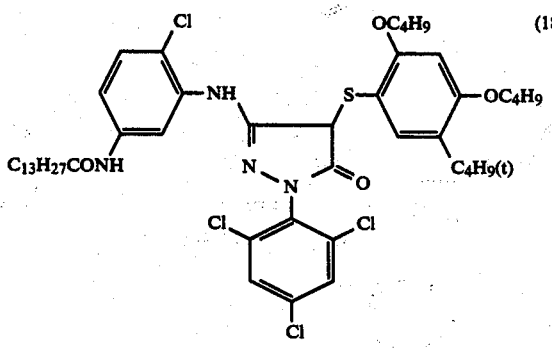
(18)

-continued
(19)
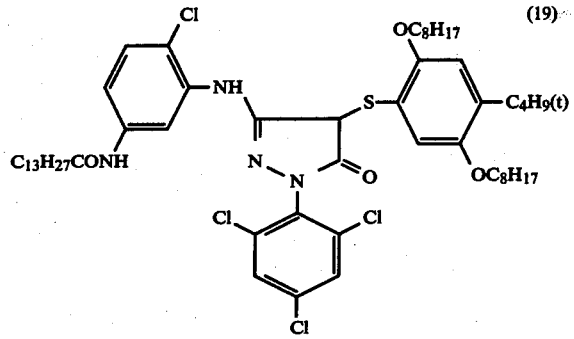
(20)
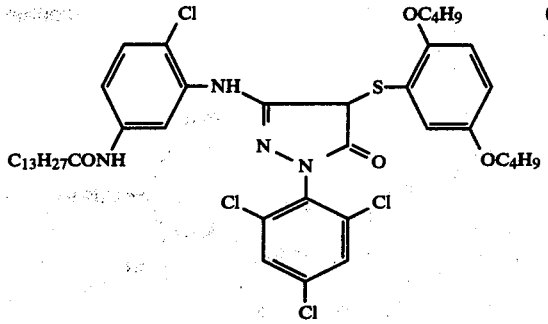
(21)
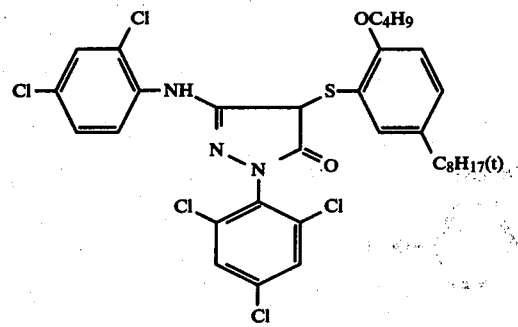
(22)
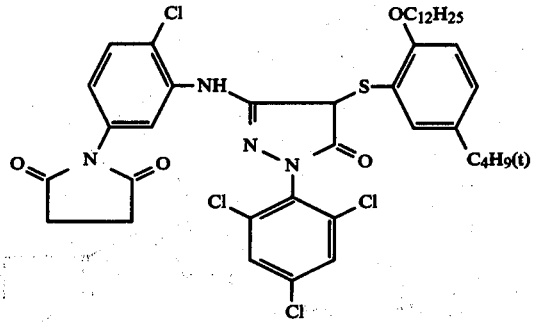
(23)
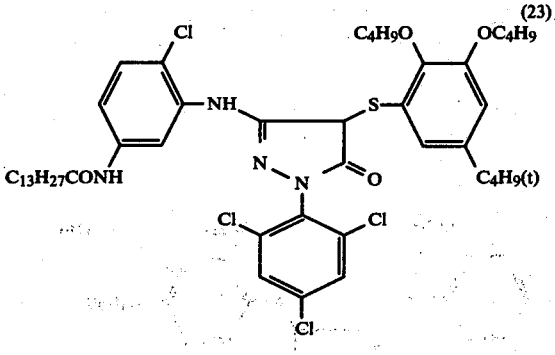
(24)
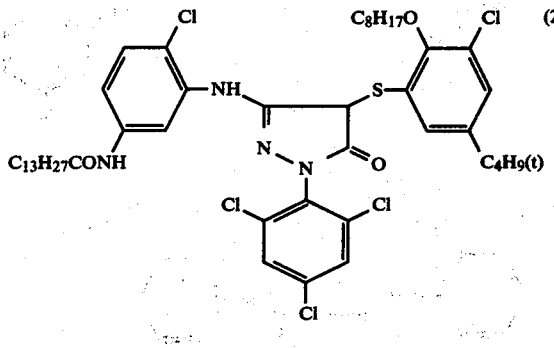
(25)
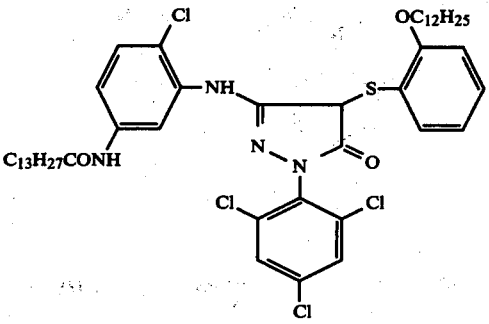
(26)
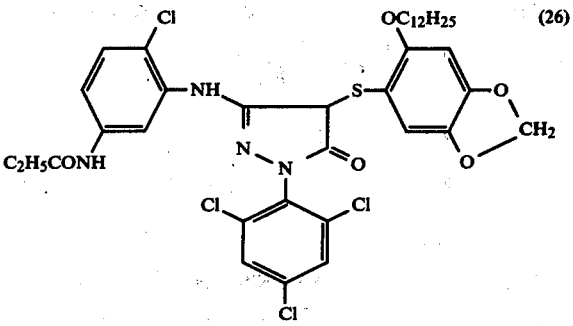
(27)
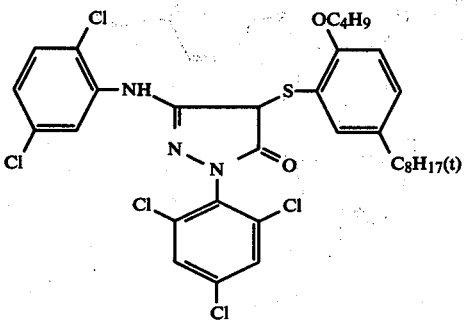
(28)
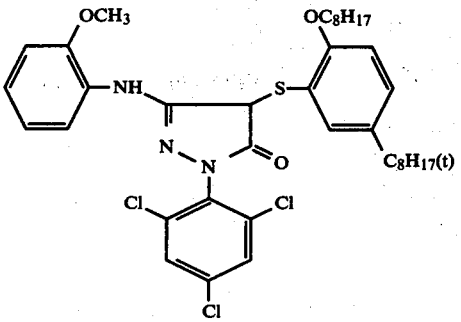

-continued

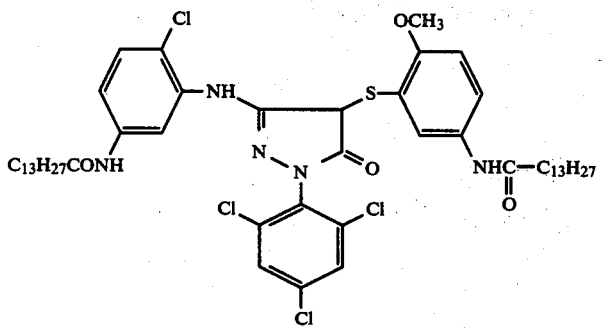

(29)

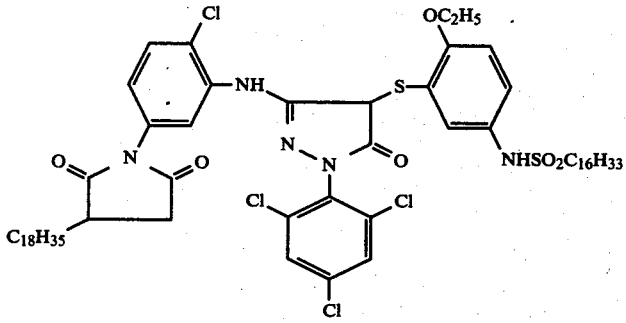

(30)

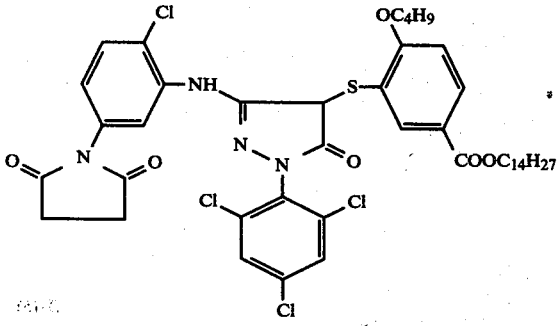

(31)

Couplers used in the present invention can be synthesized from a thiophenol derivative which becomes a group releasable by coupling and the so-called 4-equivalent coupler which is not substituted in the active coupling position according to a process described in Japanese Patent Application No. 110943/80 (corresponding to U.S. patent application Ser. No. 291,886, filed on Aug. 11, 1981).

The tetraalkoxybiindane compounds used in the present invention can be represented by the following formula (I):

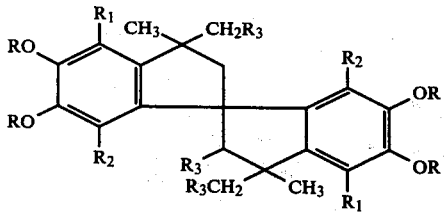

(I)

wherein R represents an alkyl group (for example, methyl, ethyl, propyl, n-octyl, tert-octyl, benzyl or hexadecyl), an alkenyl group (for example, allyl, octenyl or oleyl), an aryl group (for example, phenyl or naphthyl), a 5- or 6-membered heterocyclic group having an oxygen atom or a nitrogen atom as a hetero atom (for example, tetrahydropyranyl or pyrimidyl), $R_4CO$—, $R_4SO_2$— or $R_4NHCO$—, wherein $R_4$ represents an alkyl group (for example, methyl, ethyl, n-propyl, n-butyl, n-octyl, tert-octyl or benzyl), an alkenyl group (for example, allyl, octenyl or oleyl), an aryl group (for example, phenyl, methoxyphenyl or naphthyl) or a heterocyclic group (for example, pyrimidyl or pyridyl), $R_1$ and $R_2$ each represents a hydrogen atom, a halogen atom (for example, chlorine, fluorine or bromine), an alkyl group (for example, methyl, ethyl, n-butyl or benzyl), an alkenyl group (for example, allyl, hexenyl or octenyl), an alkoxy group (for example, methoxy, ethoxy or benzyloxy) or an alkenoxy group (for example, 2-propenyloxy or hexenyloxy), and $R_3$ represents a hydrogen atom, an alkyl group (for example, methyl, ethyl, n-butyl or benzyl), an alkenyl group (for example, 2-propenyl, hexenyl or octenyl) or an aryl group (for example, phenyl, methoxyphenyl, chlorophenyl or naphthyl).

Preferably, R represents an alkyl group, an alkenyl group, an aryl group or a 5- or 6-membered heterocyclic group having an oxygen atom or a nitrogen atom as a hetero atom. Most preferably, R represents an alkyl group.

The color image stabilizer represented by the formula (I) used in the present invention is preferably used in an amount in the range from 0.5 to 200% by weight and preferably from 2 to 150% by weight based on 4-(2-alkoxyarylthio)-5-pyrazolone coupler represented by the formula (II) or the formula (III).

The improved results obtained by using the compounds represented by the formula (I) can be increased when they are used together with known antifading agents such as hydroquinone derivatives; hydroxychroman derivatives; hydroxyspirochroman derivatives; derivatives of hydroquinone; hydroxychroman or hydroxyspirochroman derivatives wherein the hydroxyl group thereof is converted into an alkoxy group; or alkoxyphenol derivatives.

The following are examples of tetraalkoxybiindane derivatives used in the present invention. However, the compounds used in the present invention are not limited to these examples.

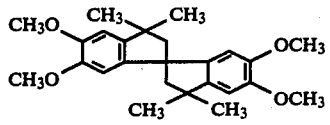
(I-1)

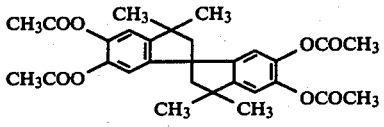
(I-2)

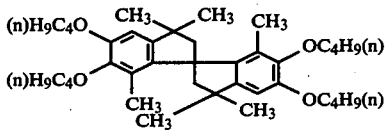
(I-3)

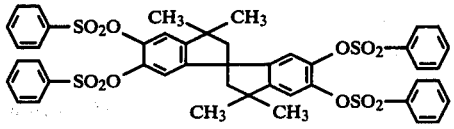
(I-4)

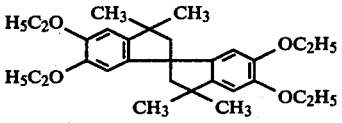
(I-5)

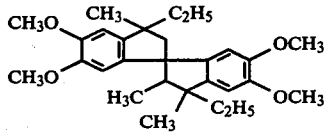
(I-6)

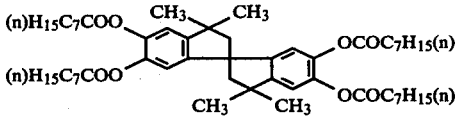
(I-7)

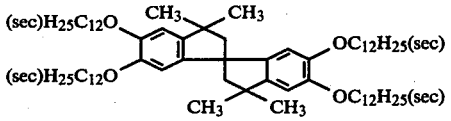
(I-8)

-continued

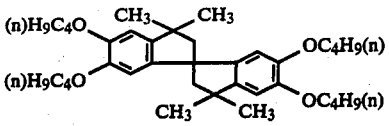
(I-9)

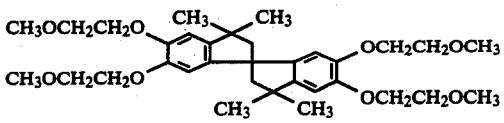
(I-10)

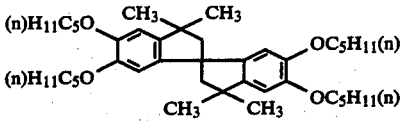
(I-11)

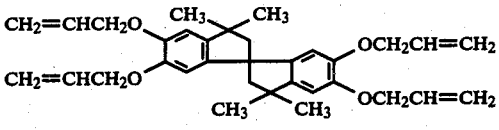
(I-12)

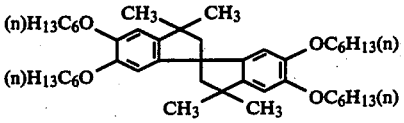
(I-13)

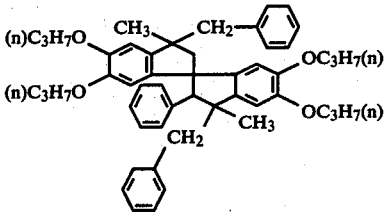
(I-14)

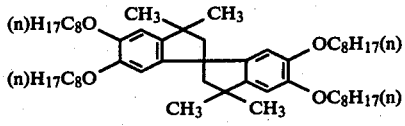
(I-15)

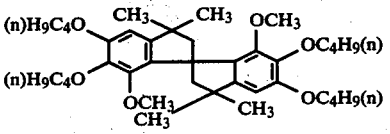
(I-16)

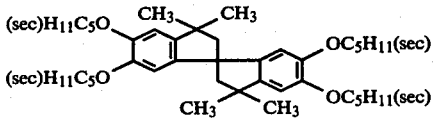
(I-17)

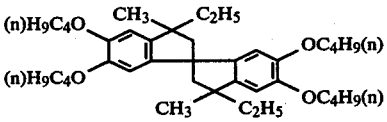
(I-18)

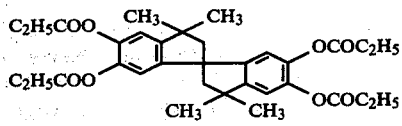
(I-19)

-continued

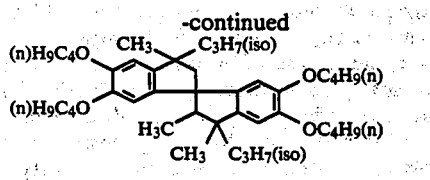

(I-20)

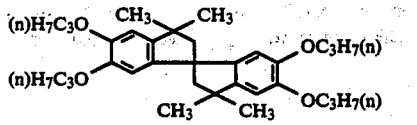

(I-21)

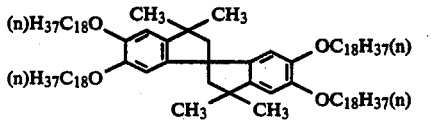

(I-22)

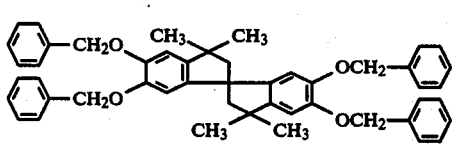

(I-23)

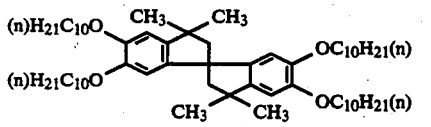

(I-24)

5,6,5',6'-Tetrahydroxy-1,1'-spirobiindane compounds used in the present invention can be synthesized according to the process described in *Journal of Chemical Society*, page 1678 (1934). Further, the compounds of the present invention can be synthesized by alkylation or esterification of 5,6,5',6'-tetrahydroxy-1,1'-spirobiindane compounds by a conventional process.

Concrete examples of synthesis were carried out according to the process described in British Pat. No. 2,077,455.

Photographic emulsions used in the present invention can be prepared by processes described in P. Glafkides, *Chimie et Physique Photographique* (published by Paul Montel Co., 1967), G. F. Duffin, *Photographic Emulsion Chemistry* (published by The Focal Press, 1966, and V. L. Zelikman et al., *Making and Coating Photographic Emulsion* (published by The Focal Press, 1964), etc. Namely, they may be prepared by any acid process, neutral process or ammonia process. Further, the reaction of soluble silver salts with soluble halogen salts may be carried out by any one-side mixing process, simultaneous mixing process or combination of them.

It is also possible to use a process for forming grains in a presence of an excess amount of silver ions (the so-called reverse mixing process). It is possible to use a simultaneous mixing process in which the pAg of the liquid phase for forming silver halide is kept at a fixed value, namely, the so-called controlled double jet process.

According to this process, silver halide emulsions having a regular crystal form and a nearly uniform particle size can be obtained.

Two or more silver halide emulsions prepared separately may be blended and used in connection with the present invention.

Introduction of the couplers and the antifading agents used in the present invention into the silver halide emulsion layers is carried out by known methods, for example, a method described in U.S. Pat. No. 2,322,027. For example, they are dispersed in hydrophilic colloids after being dissolved in alkyl phthalates (e.g., dibutyl phthalate or dioctyl phthalate), phosphoric acid esters (e.g., diphenyl phosphate, triphenyl phosphate, tricresyl phosphate or dioctylbutyl phosphate), citric acid esters (e.g., tributyl acetylcitrate), benzoic acid esters (e.g., octyl benzoate), alkylamides (e.g., diethyllaurylamide), aliphatic acid esters (e.g., dibutoxyethyl succinate or dioctyl azerate), trimesic acid esters (e.g., tributyl trimesate) or organic solvents having a boiling point of about 30° C. to 150° C., such as lower alkyl acetates (e.g., ethyl acetate, butyl acetate), ethyl propionate, secondary butyl alcohol, methyl isobutyl ketone, β-ethoxyethyl acetate or methyl cellosolve acetate, etc. The above described organic solvents having a high boiling point and the organic solvents having a low boiling point may be used as a mixture of them.

Other methods of dispersing with polymers as described in Japanese Patent Publication No. 39853/76 and Japanese Patent Application (OPI) No. 59943/76 (the term "OPI" as used herein refers to a "published unexamined Japanese patent application") may be used.

When the coupler has acid groups such as a carboxylic acid or sulfonic acid group, it is introduced into the hydrophilic colloid as an aqueous alkaline solution thereof.

EXAMPLE 1

10 g of the magenta coupler: 1-(2,4,6-trichlorophenyl)-3-[(2-chloro-5-tetradecanamide)anilino]-4-[(2-butoxy-5-tert-octyl)phenylthio]-2-pyrazolin-5-one (i.e., Coupler (5)) was dissolved in a mixture of 20 ml of tricresyl phosphate and 20 ml of ethyl acetate. The resulting solution was dispersed by emulsifiying in 100 g of a solution of gelatin containing 8 ml of a 1% aqueous solution of sodium dodecylbenzenesulfonate.

Thereafter, the resulting emulsified dispersion was mixed with 120 g of a silver chlorobromide emulsion (Br 50% by mol) (containing 7 g of Ag). After adding sodium dodecylbenzenesulfonate as a coating assistant, the mixture was applied to a paper base the both sides of which were coated with polyethylene.

The amount of the coupler coated was 300 mg/m$^2$. To the resulting layer, a gelatin protective layer (gelatin 1 g/m$^2$) was applied to prepare the Sample A.

Compounds of the present invention and comparative compounds were added as shown in Table 1, respectively, in case of preparing emulsified dispersions by the same procedure as described above. Thus, Samples B to M were prepared by the same method as in Sample A.

These samples were exposed to light for 1 second at 1,000 luxes and processed with the following processing solutions.

| | |
|---|---|
| Developing Solution | |
| Benzyl alcohol | 15 ml |
| Diethylenetriaminepentaacetic acid | 5 g |
| KBr | 0.4 g |
| $Na_2SO_3$ | 5 g |
| $Na_2CO_3$ | 30 g |
| Hydroxylamine sulfate | 2 g |
| 4-Amino-3-methyl-N—ethyl-N—β-(methanesulfonamido)ethylaniline $3/2H_2SO_4 \cdot H_2O$ | 4.5 g |
| Water to make 1,000 ml | pH: 10.1 |
| Bleach-Fixing Solution | |
| Ammonium thiosulfate (70 wt %) | 150 ml |
| $Na_2SO_3$ | 5 g |
| Na (Fe(EDTA)) | 40 g |

-continued

| | |
|---|---|
| EDTA | 4 g |
| Water to make 1,000 ml | pH: 6.8 |

| Processing Step | Temperature (°C.) | Time |
|---|---|---|
| Developing | 33 | 3 min and 30 sec |
| Bleach-Fixing | 33 | 1 min and 30 sec |
| Water washing | 28–35 | 3 min |

Each sample on which dye images were formed was subjected to a fading test for 5 days by means of a xenon tester (illuminance: 200,000 luxes) through an ultraviolet ray absorbing filter made by Fuji Photo Film Co. which cut rays of less than 400 nm. Measurement was carried out by means of a Macbeth densitometer RD-514 (Status AA Filter), and variation of density of the part having an initial density of 2.0 and variation of density of the background part were measured.

TABLE 1

| Sample | Magenta Coupler | Amount (g) | Color Image Stabilizer | Amount (g) | Variation of Yellow Density of Background | Variation of Magenta Density (initial density: 2.0) | Note |
|---|---|---|---|---|---|---|---|
| A | Coupler (5) | 10 g | — | — | +0.26 | −1.42 | Comparison |
| B | Comparative Coupler (a) | 9.8 g | — | — | +0.45 | −1.82 | " |
| C | Comparative Coupler (b) | 10.2 g | — | — | +0.33 | −1.76 | " |
| D | Comparative Coupler (c) | 8.2 g | — | — | +0.38 | −1.69 | " |
| E | Coupler (5) | 10 g | Compound (I-21) | 4 g | +0.10 | −0.19 | Invention |
| F | Comparative Coupler (a) | 9.8 g | " | " | +0.44 | −1.25 | Comparison |
| G | Comparative Coupler (b) | 10.2 g | " | " | +0.36 | −1.38 | " |
| H | Comparative Coupler (c) | 8.2 g | " | " | +0.40 | −1.35 | " |
| I | Coupler (5) | 10 g | Comparative Compound (d) | 3.3 g | +0.22 | −0.54 | " |
| J | Coupler (5) | " | Comparative Compound (e) | 4.5 g | +0.22 | −0.58 | " |
| K | Coupler (5) | " | Comparative Compound (f) | 2.5 g | +0.23 | −0.81 | " |
| L | Coupler (28) | 8.0 g | Compound (I-15) | 6.2 g | +0.09 | −0.21 | Invention |
| M | Coupler (28) | " | Comparative | 3.3 g | +0.23 | −0.89 | Comparison |

TABLE 1-continued

| Sample | Magenta Coupler | Amount (g) | Color Image Stabilizer | Amount (g) | Variation of Yellow Density of Background | Variation of Magenta Density (initial density: 2.0) | Note |
|---|---|---|---|---|---|---|---|
| | | | Compound (d) | | | | |

Comparative Coupler (a)

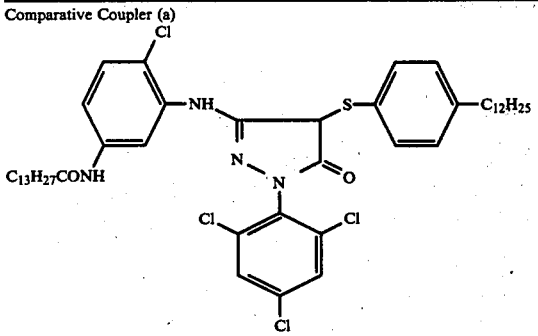

Comparative Coupler (b)

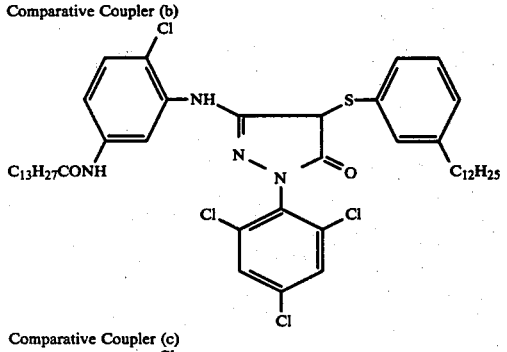

Comparative Coupler (c)

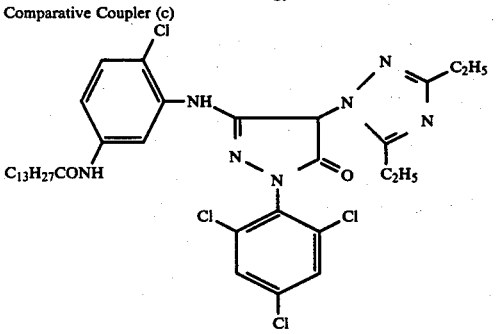

Comparative Compound (d)

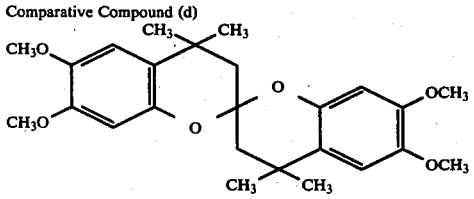

Comparative Compound (e)

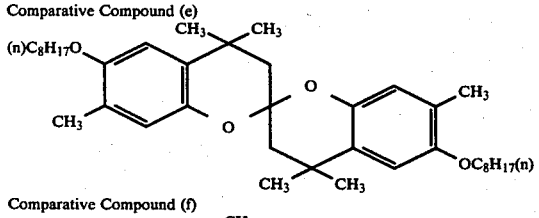

Comparative Compound (f)

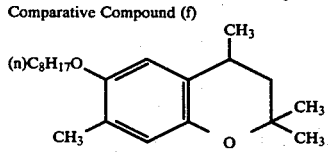

It is apparent from the results shown in Table 1 that the combination of the color image stabilizer according to the present invention with the coupler according to the present invention can remarkably prevent the formation of stain at the background and remarkably prevent the fading of the color image in comparison with other comparison combinations, i.e., the combination of the color image stabilizer according to the present invention with the comparative coupler, and the combination of the comparative color image stabilizer with the coupler according to the present invention.

EXAMPLE 2

Coating compositions for the third layer shown in Table 3 were prepared according to the process for producing the Sample A in Example 1 using the same compound as in Example 1 as the magenta coupler. Then, multilayer samples (Samples P to R) shown in Table 3 which contained the third layer were produced.

These samples were exposed to light and processed by the same procedure as in Example 1. Each sample on which dye images were formed was subjected to a fading test for 4 weeks by a fluorescent lamp fading tester (20,000 luxes). Results are shown in Table 2.

TABLE 2

| Sample | Magenta Coupler | Amount (g) | Color Image Stabilizer | Amount (g) | Variation of Yellow Density of Background | Variation of Magenta Density (initial density: 1.0) | Note |
|---|---|---|---|---|---|---|---|
| P | Coupler (5) | 10 g | — | — | +0.22 | −0.72 | Comparison |
| Q | " | " | Compound (I-21) | 4 g | +0.06 | −0.15 | Invention |
| R | " | " | Comparative Compound (d) | 3.3 g | +0.21 | −0.38 | Comparison |

TABLE 3

| | |
|---|---|
| The 6th Layer | Gelatin (coating amount: 1,000 mg/m$^2$)-Protective layer. |
| The 5th Layer (red-sensitive layer) | Silver chlorobromide emulsion (Br: 50% by mol, coating amount: silver 300 mg/m$^2$), Gelatin (coating amount: 1,000 mg/m$^2$), Cyan coupler (*1) (coating amount: 400 mg/m$^2$), and Solvent for coupler (*2) (coating amount: 200 mg/m$^2$). |
| The 4th Layer (intermediate layer) | Gelatin (coating amount: 1,200 mg/m$^2$), Ultraviolet ray absorbing agent (*3) (coating amount: 1,000 mg/m$^2$), and Solvent for ultraviolet ray absorbing agent (*2) (coating amount: 250 mg/m$^2$). |
| The 3rd Layer (green-sensitive layer) | Silver chlorobromide emulsion (Br: 50% by mol, coating amount: silver 200 mg/m$^2$), Gelatin (coating amount: 1,000 mg/m$^2$), Magenta coupler (*4) (coating amount: 300 mg/m$^2$), and Solvent for coupler (*5) (coating amount: 600 mg/m$^2$). |
| The 2nd layer | Gelatin (coating amount: 1,000 mg/m$^2$)-Intermediate layer |
| The 1st Layer (blue-sensitive layer) | Silver chlorobromide emulsion (Br: 80% by mol, coating amount: silver 400 mg/m$^2$), Gelatin (coating amount: 1,200 mg/m$^2$), Yellow coupler (*6) (coating amount: 300 mg/m$^2$), and Solvent for coupler (*7) (coating amount: 150 mg/m$^2$). |
| Base | Paper base both sides of which were laminated with polyethylene. |

(*1) Coupler: 2-[α-(2,4-di-tert-pentylphenoxy)butanamide]-4,6-dichloro-5-methylphenol
(*2) Solvent: Dibutyl phthalate
(*3) Ultraviolet ray absorbing agent: 2-(2-Hydroxy-3-sec-butyl-5-tert-butylphenyl)-benzotriazole
(*4) Coupler: 1-(2,4,6-Trichlorophenyl)-3-(2-chloro-5-tetradecanamide)anilino-4-[(2-n-butoxy-5-t-octyl)phenylthio]-2-pyrazolin-5-one
(*5) Solvent: Tricresyl phosphate
(*6) Coupler: α-Pivaloyl-α-(2,4-dioxo-5,5'-dimethyl-oxazolidin-3-yl)-2-chloro-5-[α-(2,4-tert-pentylphenoxy)butanamide]acetanilide.
(*7) Solvent: Dioctylbutyl phosphate It is apparent from the results shown in Table 1 that the combination of the color image stabilizer according to the present invention with the coupler according to the present invention can remarkably prevent the formation of stain at the background and remarkably prevent the fading of the color image in comparison with the comparison combination of the comparative color image stabilizer with the coupler according to the present invention.

While the invention has been described in detail and with reference to specific embodiments thereof, it will be apparent to one skilled in the art that various changes and modifications can be made therein without departing from the spirit and scope thereof.

What is claimed is:

1. A silver halide color photographic sensitive material comprising at least one 4-(2-alkoxyarylthio)-5-pyrazolone magenta dye forming coupler and at least one compound represented by the following formula (I):

(I)

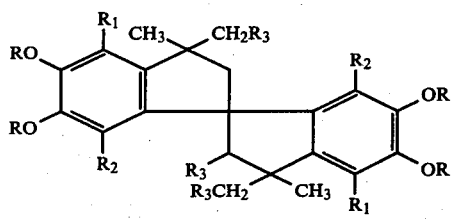

wherein each R represents an alkyl group, an alkenyl group, an aryl group, a 5- or 6-membered heterocyclic group having an oxygen atom or a nitrogen atom as a hetero atom, an $R_4CO$— group, an $R_4SO_2$— group or an $R_4NHCO$— group, $R_1$ and $R_2$ each represents a hydrogen atom, a halogen atom, an alkyl group, an alkenyl group, an alkoxy group or an alkenoxy group, and $R_3$ represents a hydrogen atom, an alkyl group, an alkenyl group or an aryl group, wherein $R_4$ represents an alkyl group, an alkenyl group, an aryl group or a heterocyclic group.

2. A silver halide color photographic sensitive material as claimed in claim 1, wherein the compound represented by the formula (I) is present in an amount in the range of from 0.5 to 200% by weight based on the weight of the 4-(2-alkoxyarylthio)-5-pyrazolone dye forming coupler.

3. A silver halide color photographic sensitive material as claimed in claim 2, wherein the compound represented by the formula (I) is present in an amount in the range of from 2 to 150% by weight based on the weight of the 4-(2-alkoxyarylthio)-5-pyrazolone dye forming coupler.

4. A silver halide color photographic sensitive material as claimed in claim 1, wherein the R represents an alkyl group, an alkenyl group, an aryl group or a 5- or 6-membered heterocyclic group having an oxygen atom or a nitrogen atom as a hetero atom.

5. A silver halide color photographic sensitive material as claimed in claim 1, wherein the R represents an alkyl group.

* * * * *